US005379205A

United States Patent [19]

Peng

[11] Patent Number: 5,379,205

[45] Date of Patent: Jan. 3, 1995

[54] STRUCTURE FOR A SWINGABLE ARM MOUNTING BASE

[76] Inventor: Chih-Wen Peng, No. 9, Lane 1, Chung Hsing Road, Sec. 1, Wu Ku Hsiang, Taipei Hsien,

[21] Appl. No.: 133,307

[22] Filed: Oct. 8, 1993

[51] Int. Cl.[6] ..... F21S 1/02

[52] U.S. Cl. ..... 362/430; 362/427; 248/276

[58] Field of Search ..... 362/370, 371, 427, 430, 362/432; 248/276, 282

[56] References Cited

U.S. PATENT DOCUMENTS

| | | | |
|---|---|---|---|
| 3,193,674 | 7/1965 | Fleming | 362/430 |
| 4,459,650 | 7/1984 | Pike | 362/430 X |
| 4,473,874 | 9/1984 | Warshawsky | 362/430 X |
| 4,661,895 | 4/1987 | Hull | 362/430 X |

*Primary Examiner*—Stephen F. Husar
*Attorney, Agent, or Firm*—Bacon & Thomas

[57] ABSTRACT

A mounting base structure for a swingable arm which is placed in an appropriate position of a wall sconce lamp, an upper and a lower securing adapters are used with a connecting member to pivotally connect the mounting base to a swingable arm. By inserting and fitting the square aperture of the adapter at one end of the swingable arm to a corresponding connecting body of a connecting member together, the assembly can be swung synchronously. By applying extrusion and stretching on both ends of the connecting body, the upper and the lower securing adapters can be integrated with the adapter on the swingable arm into a one-piece structure, preventing the electrical wiring from tangling and the swinging movement of the arm is secured and stable.

1 Claim, 6 Drawing Sheets

STRUCTURE FOR A SWINGABLE ARM MOUNTING BASE

BACKGROUND OF THE INVENTION (a) Field of the Invention

The present invention relates in general to a swing arm mounting base structure, and in particular to a new structure for a swing arm mounting base in which upper and lower adapters are used for connecting to a swingable arm of a wall sconce lamp.

(b) Description of the Prior Art

A mounting base for a swing arm light fixture is well known in the art. However, the adapter of the conventional mounting base wears out easily after a period of time. This causes an instability in the mounting and undesireable swinging of the light fixture. To overcome these problems the entire swingable arm with mounting base is made of aluminum so as to increase its durability.

SUMMARY OF THE INVENTION

The main object according to the present invention is to provide a mounting base structure for a swingable arm in which the aperture of the adapter at one end of the swingable arm is extended to hinge the connecting body of the connecting member. In addition, the two securing adapters form an integral body with the adapter of the swingable arm by extrusion and stretching, giving a secured mounting and a stable rotatable structure.

Another object according to the present invention is to provide a structure for the mounting base of the swingable arm in which the square aperture of the swingable arm is connected to a corresponding connecting body so that they can be inserted and put together. Thus the electrical wiring hole in the connecting body can be rotated together with the passage of the swingable arm, preventing the wiring from tangling and damaging.

A further object according to the present invention is to provide a mounting base structure for a swingable arm in which the connecting elements are standardized to reduce the cost in manufacturing, making it suitable for high quantity production.

Still another object according to the present invention is to provide a mounting base structure for a swingable arm in which the assembling technology is general and is easy to produce, in which copper is used in the connecting elements so as to prolong the life of the structure, in which all the connecting elements are hidden so as to enhance the appearance of the structure, in which the integral structure is decent and ideal so that it is easy and practical to promote the usage of same.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
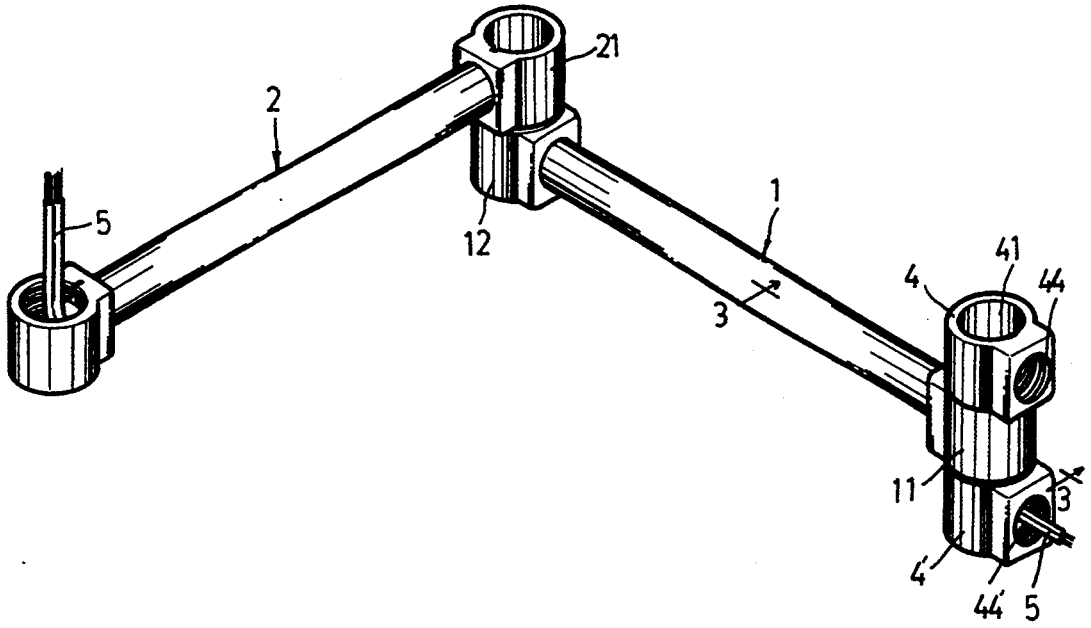
FIG. 1 is a perspective view of the swingable arm mounting base according to the present invention.

Referring to FIGS. 1, 2, 3 and 4, the swingable arm mounting base structure in accordance with the present invention mainly consists of a first swingable arm (1), a second swingable arm (2), a connecting member (3), an upper securing adapter (4) and a lower securing adapter (4'). The two ends of the adapter (11) of the first swingable arm are connected respectively through the connecting member to the upper securing adapter (4) and the lower securing adapter (4') to form an integral body. Thus the power wiring (5) will not tangle with the first swingable arm (1) and the two will be able to swing together. Also shown in FIG. 1 is another adapter (12) of the first swingable arm (1) and the adapter (21) of the second swingable arm (2) that are rotatably mounted on each other and forming a rotatable joint structure. But this rotatable joint structure is not a major issue of this invention and therefore its description will be omitted here.

Figure 2:
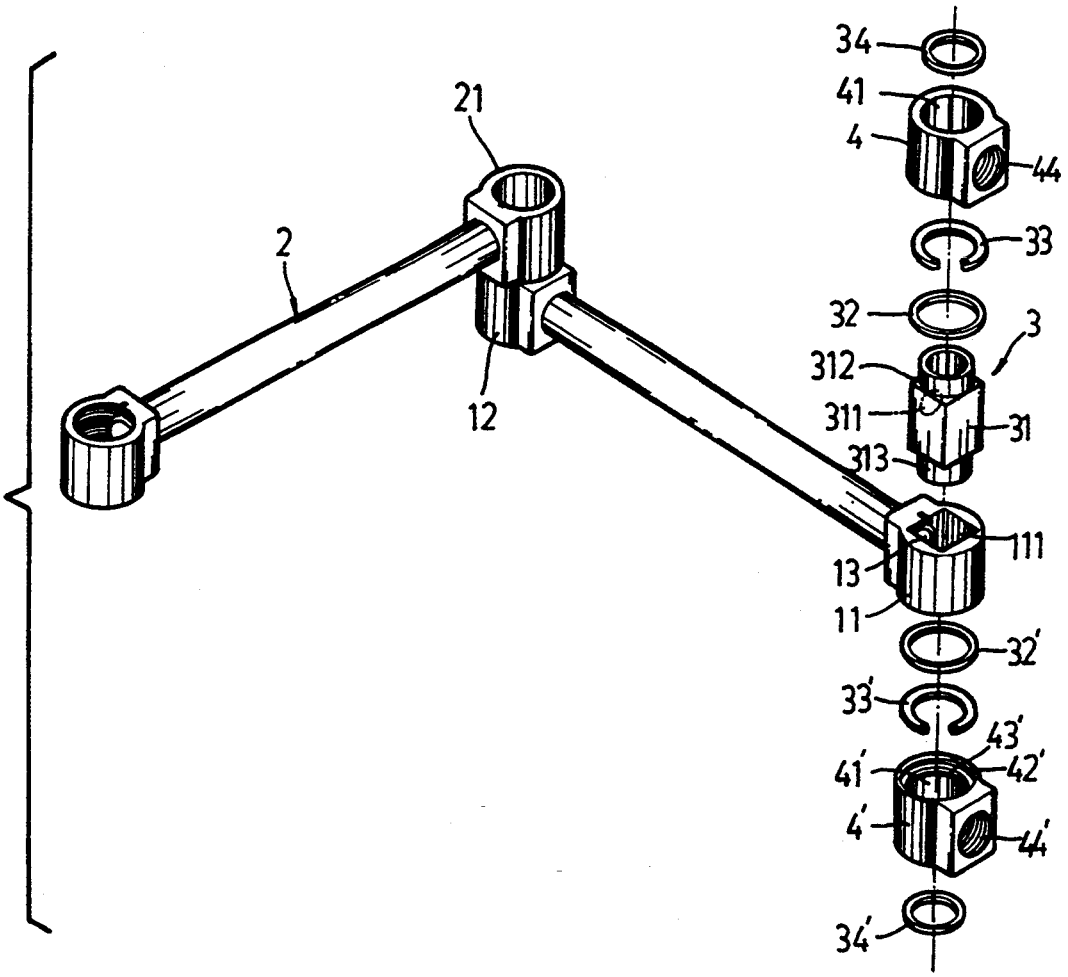
FIG. 2 is a perspective fragmented view of the swingable arm mounting base according to the present invention.
Figure 3:
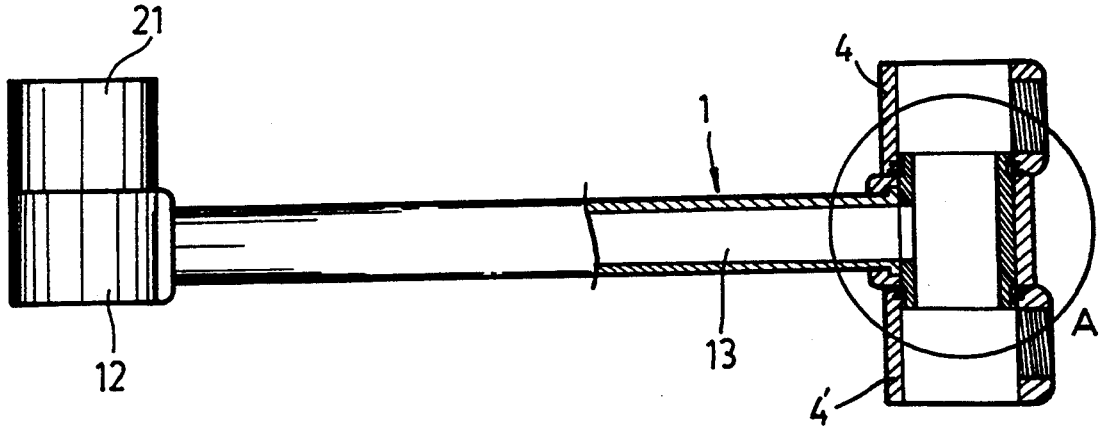
FIG. 3 is a cross-section of the swingable arm mounting base taken along line 3—3 in the direction of the arrow at FIG. 1 according to the present invention.
Figure 4:
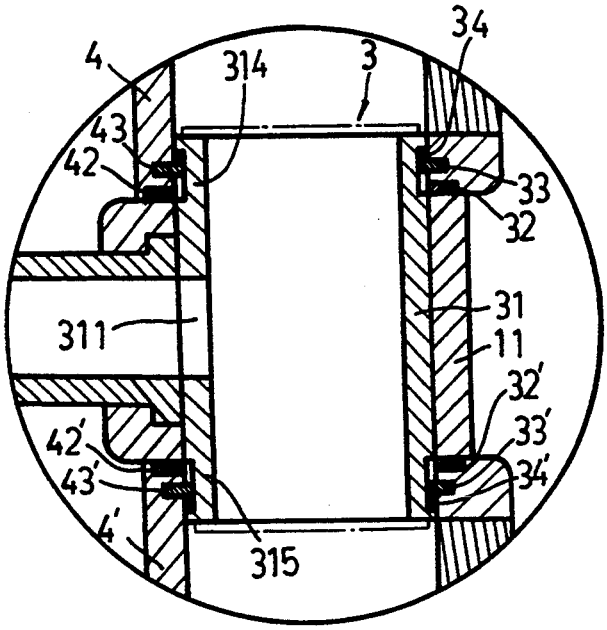
FIG. 4 is a magnified sectional view of a part A in FIG. 3.

It will be noted from FIGS. 1, 2 and 3 that the adapter (11) of the first swingable arm (1) has a square aperture (111), The center of the upper securing adapter (4) has an aperture (41) and the lower securing adapter (4') has a corresponding aperture (41'). A first groove (42) is provided on the surface along one side of the aperture (41) and the lower securing adapter (4') has a corresponding first groove (42'). A second groove (43) is provided inside the first groove (42) and a corresponding second groove (43') is provided for the lower securing adapter (4'). Moreover, the connecting member (3) has a connecting body (31), two anti-friction plates (32) and (32'), two C-shaped ring (33) and (33') and two washers (34) and (34'). The connecting body (31) is in the form of a square tube which can be disposed in the aperture (111) of the first swingable arm (1). An electrical wiring hole (311) is provided in a location confronting the passage (13) of the first swingable arm (1). Each end of the connecting body (31) has a flange ring (312 or 313) of smaller diameter. The two C-shaped rings (33 and 33') are then fed in the second grooves (43) and (43') of the securing adapters (4) and (4'). The diameter of each C-shaped ring is a little larger than that of each groove and it is flexed in the groove for the purpose of fixing the C-shaped ring in the groove. After the C-shaped rings are processed, two anti-friction plates (32) and (32') are inserted in the first grooves (42) and (42'). The connection body (31) is then put through the square aperture (111) with the electrical wiring hole (311) confronting the passage (13) of the first swingable arm (1). At this moment, the flange rings (312) and (313) are put through two anti-friction rings (32) and (32'), C-shaped rings (33) and (33') and two washers (34) and (34') which are located on the other sides of the C-shaped rings (33) and (33'). By extrusion and stretching the two ends of the flange rings (312) and (313) are extended outwardly to form a positioning ring for swinging, as shown in FIG. 4.

Figure 5:
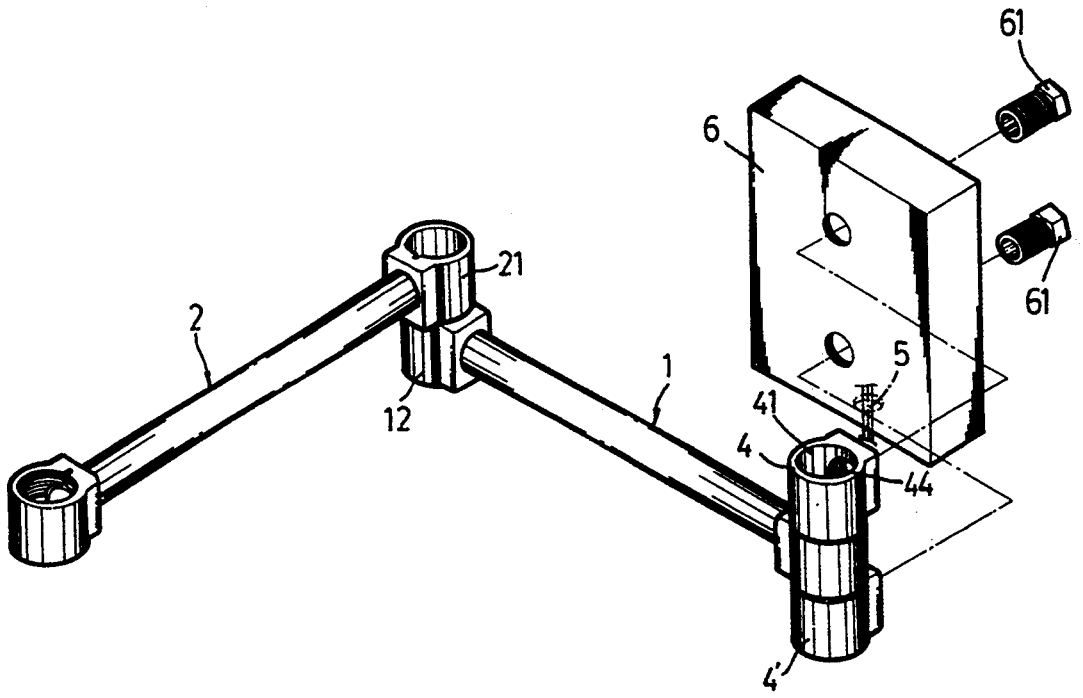
FIG. 5 shows an embodiment according to the present invention.
Figure 6:
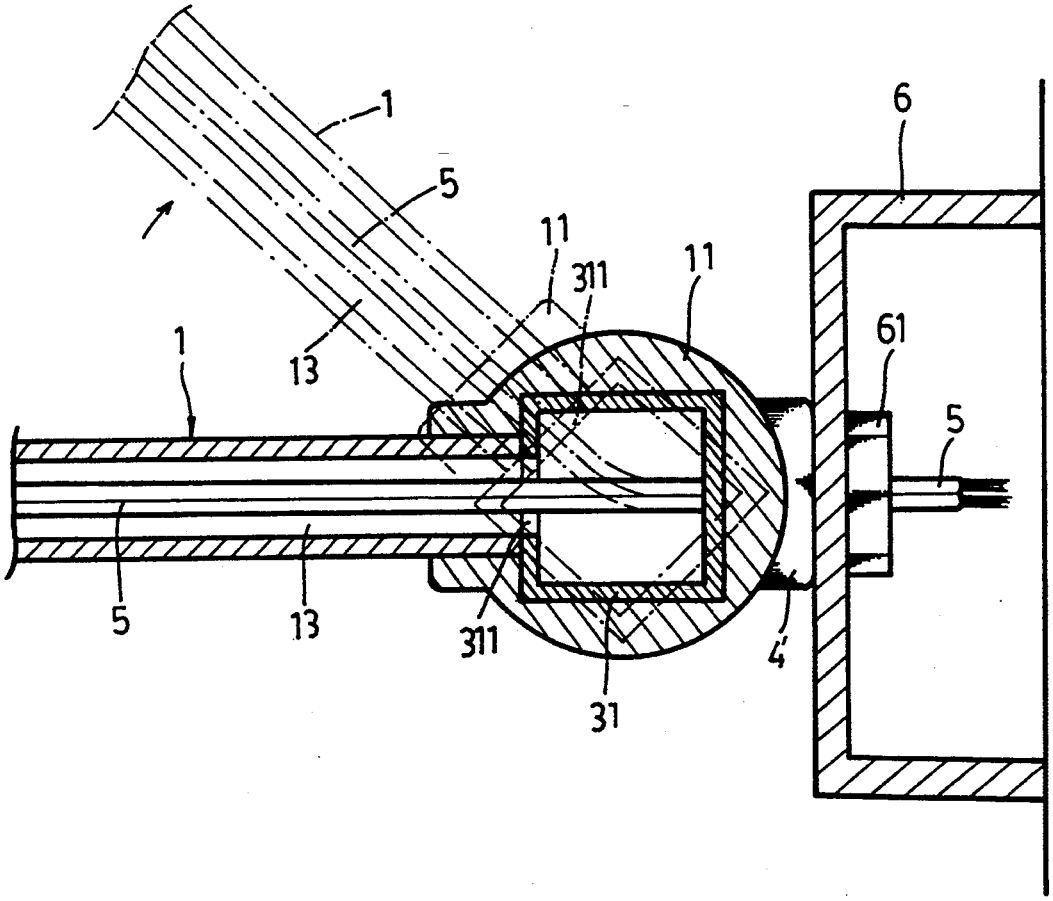
FIG. 6 is a diagrammatic view showing the swinging of the arm mounting base structure according to the present invention.

Referring to FIGS. 5 and 6 for a description of the characteristic of the swingable arm mounting base structure according to the present invention. The assembly of the present invention is mounted on a mounting block 6 on top of the base of the wall sconce lamp. The upper and the lower securing adapters (4) and (4') are used with the connecting member (3) to pivotally connect to the two ends of the adapter 11 of the first swingable arm (1). The hollow screws (61) are then secured on the mounting block (6). At this time the electrical wiring (5) can be fed through the screw hole (44) of the upper securing adapter (4) into the aperture (41), or it can also be fed through the screw hole (44') of the lower securing adapter (4') into the aperture (41'). Feeding through the electrical wiring hole (311) of the connecting body (31), the electrical wiring (5) communicates with the passage (13) of the first swingable arm (1). Moreover, the square aperture (111) of the first swingable arm (1) is fitted to the corresponding connecting body (31). This allows the electrical wiring hole (311) provided in the connecting body (31) to be able to swing synchronously with the passage (13) of the first swingable arm (1). Hence, the electrical wiring (5) will not be tangled and damaged. By securing with the upper and the lower securing adapters (4) and (4'), the complete assembly is solidly mounted and its rotatability is expanded. It is therefore a very practical device.

Although the preferred embodiment of the invention is illustrated in the drawings and previously described in detail, this invention contemplates any configuration, design and relationship of components which will function in a to similar manner and which will provide the equivalent result.

For the whole connecting structure aluminum is used in case of frequent swinging to cut out inside structure. C-shaped rings are made of steel for adapters holding together with the connecting body in extrusion and stretching to make a strong structure. Anti-friction plates are made of hard plastic to solve the infeasibility of the friction between aluminum adapters to cut out each other. As to steel washers located on the other sides of C-shaped rings, they could separate flange rings from aluminum after extrusion and stretching to make the arm swing more smoothly.

What is claimed is:

1. A mounting base structure for a swingable arm which is placed in an appropriate position of a wall sconce lamp, an upper securing adapter and a lower securing adapter used with a connecting member to pivotally connect the mounting base to a swingable arm, characterized in that said swingable arm having an adapter with a square aperture at one end, the centers of the upper and the lower securing adapters have a passage, a first groove is provided on the surface along one side of the aperture, a second groove is provided inside the first groove, said connecting member is provided inside the first groove, said connecting member is provided with a connecting body, two anti-friction plates, two C-shaped rings and two washers, the connecting body being a square tube for insertion into the passage of the swingable arm and has a flange ring of smaller diameter at each end, and electric wiring hole is provided in a location confronting the passage of the swingable arm, the two C-shaped rings being insertable into the second grooves of the two securing adapters to project into the wall of the aperture, the two anti-friction plates being insertable into the first grooves of the two securing adapters respectively, both ends of the connecting body are feedable through the two C-shaped rings and the two washers are insertable, and by extrusion and stretching process the two flange rings of the connecting body are extended outwardly to form a positioning ring for swinging.

* * * * *